US006261653B1

(12) United States Patent
Smith

(10) Patent No.: US 6,261,653 B1
(45) Date of Patent: Jul. 17, 2001

(54) MOLDED PRODUCT CUSHIONING DEVICE

(76) Inventor: Forrest Smith, 1053 Avenue Road, Toronto, Ontario (CA), M5N 1X5

( * ) Notice: Subject to any disclaimer, the term of this patent is extended or adjusted under 35 U.S.C. 154(b) by 0 days.

(21) Appl. No.: 09/286,843

(22) Filed: Apr. 6, 1999

(51) Int. Cl.[7] ..... B65D 85/30; B65D 81/02

(52) U.S. Cl. ..... 428/35.7; 206/453; 206/521; 206/586; 206/591; 206/592

(58) Field of Search ..... 428/34.1, 35.7; 206/453, 586, 522, 592, 591, 521; 248/345.1

(56) References Cited

U.S. PATENT DOCUMENTS

| | | | | |
|---|---|---|---|---|
| 2,874,826 | | 2/1959 | Matthews et al. . | |
| 3,244,347 | * | 4/1966 | Jenk | 206/586 |
| 3,294,223 | | 12/1966 | Goban . | |
| 3,975,564 | | 8/1976 | Jones . | |
| 4,202,449 | * | 5/1980 | Bendt | 206/453 |
| 4,482,054 | * | 11/1984 | Gardner | 206/453 |
| 4,483,444 | * | 11/1984 | Gardner | 206/453 |
| 4,742,916 | * | 5/1988 | Galea | 206/586 |
| 4,877,673 | * | 10/1989 | Eckel et al. | 206/453 |
| 4,905,835 | | 3/1990 | Pivert et al. . | |
| 5,226,543 | | 7/1993 | Foos et al. . | |
| 5,267,651 | * | 12/1993 | Hughes | 206/586 |
| 5,385,232 | | 1/1995 | Foos et al. . | |
| 5,515,976 | | 5/1996 | Moren et al. . | |
| 5,626,229 | | 5/1997 | Dickie et al. . | |
| 5,628,402 | | 5/1997 | Dickie et al. . | |
| 5,799,796 | | 9/1998 | Azelton et al. . | |
| 5,826,726 | | 10/1998 | Yang . | |
| 5,918,800 | * | 7/1999 | Goshorn et al. | 206/586 |
| 6,039,184 | * | 3/2000 | Gale | 206/586 |
| 6,059,104 | * | 5/2000 | Widman | 206/586 |

FOREIGN PATENT DOCUMENTS

| | | |
|---|---|---|
| 70 27 767 U | 12/1970 | (DE) . |
| 2381685 | 9/1978 | (FR) . |

* cited by examiner

*Primary Examiner*—Rena L. Dye
(74) *Attorney, Agent, or Firm*—Marks & Clerk

(57) ABSTRACT

A unitary product cushioning device is provided for supporting a shock sensitive product in an outer packaging container, and is formed of a moldable resilient plastics material. The device comprises a post structure, with a first closed end and a second open end, with the open end having a curved ridge formed at at least a first side of the post structure, and terminating in a container contacting flange at the end of the curved ridge remote from the open end. A portion of the curved ridge presents a product supporting surface; and a further portion of the curved ridge is curved in a direction outwardly and away from the post structure. There may be a container contacting surface near the closed end of the post structure. When the unitary product cushioning device is placed in a container so that the post structure extends into a corner defined by at least two surfaces of the container, at least the container contacting flange will contact one of the at least two surfaces, and the product supporting surface will be parallel to that one of the at least two container surfaces. When a shock load is applied to the unitary product cushioning device in a direction towards the contacted container surface, the curve of the curved ridge will at least temporarily be further curved in a direction away from the post structure, and product supporting surface will at least temporarily move closer to the contacted container surface.

40 Claims, 3 Drawing Sheets

MOLDED PRODUCT CUSHIONING DEVICE

FIELD OF THE INVENTION

This invention relates to product cushioning devices for use in packaging shock sensitive products. In particular, the invention relates to re-usable or recyclable product cushioning devices which are made from plastics material, and which may have several different embodiments including corner pieces, edge pieces, and end caps. Each of the embodiments of the present invention comprises a unitary structure which may be molded from a plastics material using a variety of molding techniques.

BACKGROUND OF THE INVENTION

The use of product cushioning devices for shock sensitive products has been known for many years. Typically, cushioning for shock sensitive devices comprises a number of different approaches, each of which may have its own particular advantages and/or disadvantages.

For example, it has been known for many years to wrap shock sensitive or delicate devices or merchandise in tissue paper, and to cushion the products with loosely balled tissue paper. Another use of paper has been shredded paper, or excelsior. A more elegant approach has been to use bubble-pack, which comprises a sheet material having a plurality of contained bubbles of air formed therein. Another approach which has been used for many years has been the use of a plurality of discrete molded foamed polystyrene pellets, sometimes referred to as "peanuts" in the industry, to fill around a product in a container.

As the requirement for better packaging and cushioning became more demanding, for example with the introduction to the market of complicated and expensive electronics devices such as computer monitors, and more particularly notebook computers, printed circuit boards, and the like, the requirement arose for more sophisticated and better shock absorbing cushioning devices. Standards were developed for acceptance of cushioning devices, including drop tests and the like, to determine if such devices would protect the shock sensitive product from shock acceleration greater than the product's fragility level—typically, from 20 g's to 100 g's.

This has given rise to the use of such products as honeycomb cardboard, and particularly foamed polystyrene, foamed polyurethane, foamed polypropylene, or foamed polyethylene. Flexible foam devices are well known for use as corner pieces or edge pieces. Likewise, foamed polystyrene products—which are more rigid—are also well known for use as corner pieces or end caps; and very often, they are product specific in that they are particularly molded having a specific configuration for use with a particular product.

In general, however, flexible foam cushioning devices, and foamed polystyrene cushioning devices, are not recyclable. There are several reasons for that condition: The first is that flexible foam cushioning devices, and polystyrene cushioning devices, tend to be quite bulky, and are usually discarded with the packaging container in which the product has been shipped. There are very few specific recycling depots that are set up for either flexible foam or especially polystyrene cushioning devices; and, in any event, foamed polystyrene and foamed polyurethane cannot generally be recycled. Its re-usability may be provided for, particularly as general corner pieces, if they remain intact, or as product specific end caps; but, unless such foamed polystyrene cushioning devices are being used in a closed shipping system, they will not be recovered for re-use. Moreover, foamed polystyrene cushioning devices tend to be very frangible, and do not maintain their integrity very well once they have been used and removed from the packaging container in which they are shipped.

More elegant cushioning devices have more recently entered the market, comprising different types of blow-molded or other plastics shell products, most of which are closed structures which are filled with air or other gas. Some such structures are inflatable, some are closed, and some may be open to the atmosphere but are formed of a relatively rigid material. All such products are generally formed from high density polyethylene, which may be recycled because it is easily chopped up and made into further products, or such products may be re-usable if they are employed in a closed delivery and recovery system. Low density polyethylene may also be found in products such as those described immediately above, although its use is quite limited at the present time.

As will be discussed in greater detail hereafter, the present invention also provides a recyclable and re-usable product cushioning device which has a unitary construction and is formed of a plastics material. As noted, the present invention provides such a product cushioning device as a corner piece, an end piece, or an end cap. However, the present invention does not present a closed structure, such as a number of prior art devices which are discussed hereafter; rather, the present invention provides a product cushioning device which is such that it may be stackable. This feature means that product cushioning devices in keeping with the present invention may be stored in much smaller storage volumes than previously may have been required at the factory or shipping warehouse where the products in association with which the product cushioning devices of the present invention will be used. Moreover, when the products have been delivered to the end user, the product cushioning devices may again be stacked for re-usability, or even roughly cut or chopped up for recycling of the material.

Still further, as will be described in greater detail hereafter, the present invention provides unitary product cushioning devices which afford at least two discrete contact and shock transmitting regions in at least one direction; end caps and corner pieces in keeping with the present invention provide at least two directions of shock absorbing protection.

DESCRIPTION OF THE PRIOR ART

U.S. Pat. No. 2,874,826 issued to MATTHEWS et al. is directed to a shock and vibration isolation device which, however, is not intended for being incorporated in a rectilinear container. Rather, this device is a resilient and inflatable jacket comprising a plurality of chambers, made of a rubberized fabric which is adapted to hold a gas under pressure, and which will be wrapped around a shock sensitive device such as a guided missile so as to provide a shock and vibration isolation container therefor.

GOBAN U.S. Pat. No. 3,294,223 teaches a molded plastic corner piece having the configuration of a triangular polyhedron which is either rounded or flattened at its apex. The purpose of the corner support is to entrap air between the molded plastic corner piece and the corner of the carton into which it is placed.

U.S. Pat. No. 4,905,835 issued to PIVERT et al. teaches inflatable cushion packaging wherein a plurality of chambers are inflated so as to provide cushioning which will absorb shock and thereby protect a shock sensitive product located in the centre of the container. The amount to which the balloon-like chambers may be inflated, and therefore their hardness, may be controlled.

FOOS et al. U.S. Pat. No. 5,226,543 teaches a packaging structure which includes both a platform portion and a sidewall portion, wherein the sidewall portion forms an enclosure around the platform portion. Essentially, this product is an end cap or platform. The sidewall has both inner and outer walls which are joined by a bridge section, and the inboard wall is relatively shorter than the outboard wall such that the platform portion holds the fragile article at a specific distance above the lower edge of the outboard wall. Shock absorbing formations—typically, notches—are formed in the bridge portion of the sidewall. These notches have a degree of elasticity such that, when the packaging structure is loaded and then unloaded, or shocked and then unloaded, the notch will return to its original shape and can absorb multiple loads without deteriorating. However, in order for the elasticity to exist, a material with a high degree of stiffness must be used—typically, that material is high density polyethylene. The patent requires that the inboard wall is shorter than the outboard wall.

Another patent issued to Foos et al. is U.S. Pat. No. 5,385,232. This patent also teaches a sidewall structure which forms an enclosure around a platform portion. However, the teachings of this patent also address the issue of light shock loads that may not deform or compress the shock load formations—the notches that are discussed in the previous Foos et al. patent. Here, the concept of openings which provide for collapsibility and allow for the release of compressed air beneath the package when the package is subject to shock loading, is introduced. These collapsible openings may be located in the platform at various locations, and may have a variety of shapes. Still, like the other Foos et al. patent, the teaching is directed to the use of inboard and outboard walls as well as the use of the shock formations (the notches) that have an elastic characteristic.

MOREN et al. U.S. Pat. No. 5,515,976 teaches a structure which has side flanges that are adapted to contact all sides of an end portion of a fragile article, and is thus configured as an end cap. There are a number of protrusions disposed throughout the sidewalls to support the article. There is also a notch provided in the side wall as a means to absorb shock loads. The end cap of this patent is also provided with at least one crush button for absorbing shocks applied along the longitudinal length of the fragile article.

Two related patents issued to DICKIE et al., U.S. Pat. No. 5,626,229 and No. 5,628,402 each are directed to a gas-containing product supporting structure which takes the form of a plastic bladder shaped on one side to provide a cavity having internal dimensions which match the external dimensions of the product to be protected, and shaped on its other side to have external dimensions which match the internal dimensions of the shipping container into which it is placed. The product is semi-rigid and self-supporting, monolithic, and gas-containing and may take the form of a corner piece or an end piece or tray for the product to be protected. The semi-rigid and self-supporting gas-containing bladder will retain its shape irrespective of whether it is sealed or open to the ambient surroundings; and will generally comprise a plurality of chambers in the interior of the product supporting structure with gas communication between the chambers so that the gas that is within the structure may flow from one chamber to another during shock loading circumstances of operation.

Finally, AZELTON et al. U.S. Pat. No. 5,799,796 teaches a unitary spring system end cap packaging unit. Here, the structure includes an inner wall, an outer wall, and a spring system disposed between them. The spring system includes at least one flexible harmonic bellows which forms a flexible ridge that has an arcuate shape along the length of the sidewall structure. A cushioning space exists between the edge of the inner sidewall and the edge of the outer sidewall. Dimples may be provided on the inner surfaces of the sidewall to allow a friction fit of the end cap to the product over which it will be placed. The arcuate harmonic bellows form flexible ridges that are elastic in nature; and each bellows of the spring system operates independently when a shock load is applied.

SUMMARY OF THE INVENTION

In its broadest sense, and as a common feature of any of the embodiments of the present invention—corner piece, edge piece, or end cap—the present invention provides a product cushioning device which, in all events, is intended for supporting a shock sensitive product in an outer packaging container. In its broadest sense, the present invention is applicable for use in any container which has at least parallel and planar top and bottom surfaces and at least three planar sides surfaces, each of which is perpendicular to the planar top and bottom surfaces. As will be discussed hereafter, in several embodiments of the present invention, the post structure may have several configurations, such that it may or may not contact one or more of the planar surfaces of the container. In any event, and in its broadest sense, the unitary product cushioning device of the present invention is formed of a moldable resilient plastics material and comprises:

A post structure having a first closed end and a second open end. The open end of the post structure has a first curved ridge formed at at least a first side of the post structure, and that ridge terminates in a first container contacting flange at the end thereof which is remote from the open end of the post structure.

A portion of at least the first curved ridge at the first side of the post structure presents a product supporting surface.

A further portion of at least the first curved ridge at the first side of the post structure is curved in a direction outwardly and away from the post structure.

When the unitary product cushioning device is placed in a container so that the post structure extends towards a corner defined by at least two surfaces of the container, the first container contacting flange will contact one of the planar surfaces of the container. The product supporting surface will be parallel to that contacted surface.

When a shock load is applied to the unitary product cushioning device in a direction towards the one of the planar surfaces which has been contacted by the container contacting flanges, the curve of the curved ridge will at least temporarily be further curved in a direction away from the post structure. Moreover, the product supporting surface will also at least temporarily move closer to that surface.

In one embodiment of the present invention, the post structure may be curved away from the second open end thereof. In a further, more general, embodiment of the present invention, the post structure has a pair of sidewalls which extend away from the second open end of the post structure, where the sidewalls will terminate in the closed end of the post structure.

In a particular embodiment of the present invention, at least one of the pair of sidewalls of the post structure has a container contacting surface near the closed end. Thus, when the unitary product cushioning device is placed in a outer packaging container. The container contacting surface will contact one of the corner defining planar surfaces of the container.

More especially, it is usual that the container contacting surface of the post structure is on the sidewall thereof which is at the first side of the post structure, so that each of the container contacting surface and the first container contacting flange will contact the same planar surface of the container.

In general, the post structure of a unitary product cushioning device may be placed into a container in such a manner that it will extend towards a corner which is defined by at least one of the planar sides of the container and one of the planar top and bottom surfaces. For example, an end cap might be used in a triangular shaped container in such a manner that the first container contacting flange will contact one of the planar side surfaces of the container, and the first product supporting surface will be parallel to that planar side surface.

There may be an axis of symmetry which bisects the post structure. If so, there will be first and second curved ridges that are formed at first and second sides of the post structure, and each of the first and second curved ridges will terminate at a respective first and second contacting flange.

Moreover, the post structure may be configured so that a container contacting surface is to be found on each of the pair of sidewalls which define the post structure.

In a more particular embodiment of the present invention, the unitary product cushioning device is intended for use in an outer packaging container which has a rectilinear configuration. However, as otherwise expressed above, the unitary product cushioning device comprises a post structure with a first closed end and a second open end, and with the open end having a first curved ridge formed at at least a first side of the post structure. The first curved ridge terminates at a first container contacting flange at the end thereof remote from the open end of the post structure.

A portion of at least the first curved ridge at the first side of the post structure presents a product supporting surface. A further portion of the at least first curved ridge is curved in a direction outwardly and away from the post structure.

Thus, when the unitary product cushioning device of this embodiment is placed in a rectilinear container so that the post structure extends towards a corner defined by at least two surfaces of the rectilinear container, the container contacting flange will contact one of the at least two container surfaces, and the product supporting surface will be parallel to that one of the at least two container surfaces. Moreover, when a shock load is applied to the unitary product cushioning device in a direction towards the contacted surface, the further portion of the first curved ridge will at least temporarily be further curved in a direction outwardly and away from the post structure, and the product supporting surface will at least temporarily move closer to the one of the at least two container surfaces.

If the unitary product cushioning device of the present invention is to be utilized as either an edge piece or an end cap, there may be an axis of symmetry which bisects the post structure. Thus, a curved ridge will be formed on both a first and second side of the axis of symmetry at the first and second sides of the post structure. There will thus be provided a container contacting flange at both sides of the post structure.

In this case, the container contacting flanges are disposed in first and second planes which are substantially perpendicular one to the other.

Moreover, there is a product supporting surface and a container contacting surface on each side of the post structure. Each of the product supporting surfaces is near the open end of the post structure, and each of the container contacting surfaces is near the closed end of the post structure. The container contacting surfaces at each side of the post structure are also each disposed in each of the first and second planes.

Thus, when the unitary product cushioning device is placed in a rectilinear container, the container contacting surfaces and the container contacting flanges will each contact a respective one of the at least two surfaces of the rectilinear container in the corner defined thereby, and each of the product supporting surfaces will be parallel to a respective one of the two surfaces.

It should be noted that unitary product cushioning device in keeping with the present invention may be designed so as to be specifically non-symmetrical. Such a non-symmetrical unitary product cushioning device will find its usefulness in association with some products which may have a more pronounced shock sensitivity in one direction than in another, generally perpendicular, direction.

If the unitary product cushioning device is to be utilized as an edge piece, then the device may be formed of an extruded plastics material. In that case, the device will have first and second ends, each of which is open.

However, if the unitary product cushioning device of the present invention is to be formed as an end cap, it may be molded by drape molding, vacuum molding, blow molding, or injection molding. In that case, the end cap will have a predetermined length, and will have first and second ends which are closed. Also, the post structure will have first and second ends which are closed.

Typically, the unitary product cushioning device, when configured as an end cap, will be such that the length of the post structure is less than the length of the end cap. Moreover, the end cap will further comprise a pair of extension wings, one at each of the first and second closed ends thereof.

Each of the extension wings comprises a curved ridge which is curved away from the post structure, and which terminates in a container contacting flange. Each of the container contacting flanges of the extension wings is disposed in one of a pair of further planes. Those planes will exhibit parallelism to one another, plus or minus zero degrees to 10°. Thus, the planes in which the container contacting flanges of the extension wings may be disposed may be parallel, or they may be as much as 10° off parallel each to the other. Indeed, the planes in which the container contacting flanges of the extension wings may be out of parallelism by as much as 40° or more, but the placement of such a unitary product cushioning device in a container may be different.

The predetermined length of the end cap is measured between the container contacting flanges of the extension wings.

The unitary product cushioning device may further comprise a pair of rectilinear depressions which are formed one at each end of the post structure. Each of the rectilinear depressions has a substantially planar end wall and a pair of sidewalls that are substantially perpendicularly disposed to each other, and which intersect at a vertex which is disposed along the axis of symmetry of the unitary product cushioning device.

Thus, a pair of similarly configured unitary product cushioning devices may be employed at opposed sides of a rectilinear container, so as to cushion a rectilinear product therein.

Indeed, the unitary product cushioning device as described immediately above may be formed as a pair of similarly configured devices which are joined together at a respective one of the container contacting flanges at a respective first or second side of the respective post structure of each.

Still further, when the unitary product cushioning device is formed as a pair of similarly configured unitary product cushioning devices, it may have a further extension structure which is interposed between a respective one of the container contacting flanges at a respective first or second side of the respective post structure of each device.

Then, the further extension structure may be formed with a centrally located ridge which is parallel to the container contacting flanges of each of the pair of similarly configured unitary product cushioning devices, and a pair of rims is located one at each side of the centrally located ridge. A flexible hinge is formed between each of the pair of rims and the respective container contacting flange.

Each of the rims, or each of the curved ridges, may be configured having an upstanding wing portion; and each of the curved ridges which is adjacent the centrally located ridge, or each of the rims, may be configured having a co-operating opening formed therein. Thus, when the respective container contacting flanges and the rims are oriented towards each other by the flexible hinges having been bent, each of the upstanding wing portions will be received in the respective co-operating opening so as to lock the pair of similarly configured unitary product cushioning devices and the interposed ridge structure in place. Accordingly, the structure which comprises the similarly configured unitary product cushioning devices and the interposed ridge portion may be placed at opposed sides of a rectilinear container of a predetermined size, and it will receive a rectilinear product having a predetermined dimension in the rectilinear depressions of each of the similarly configured unitary product cushioning devices.

As noted above, the unitary product cushioning device of the present invention may be formed as a corner piece to be fitted into a rectilinear container. In this case, the corner is one which is defined by three intersecting surfaces which are mutually perpendicular one to another.

When the unitary product cushioning device of the present invention is configured as a corner piece, the post structure is formed having an isosceles triangular cross-section, having a base portion and two side portions. The post structure is truncated.

The open end of the post structure has at least a first curved ridge which is formed at the base portion side thereof, and the at least first curved ridge terminates in a container contacting flange at the end thereof which is remote from the open end of the post structure. A portion of the at least first curved ridge presents a first product supporting surface; and a further portion of the at least first curved ridge is curved in a direction outwardly and away from the post structure.

When the unitary product cushioning device which is conformed as a corner piece is fitted into a corner of a rectilinear container, one of the three intersecting surfaces of the rectilinear container will be contacted by the container contacting flange at the base portion side of the post structure.

The first product supporting surface will be parallel to the one contacted container surface.

When a shock load is applied to the unitary product cushioning device in a direction towards the one contacted container surface, the further portion of the first curved ridge will at least temporarily be further curved in a direction away from the post structure, and the first product supporting surface will at least temporarily move closer to the one contacted container surface.

In a particular embodiment of corner piece in keeping with the present invention, the post structure has an equilateral triangular cross-section. In this embodiment, a curved ridge is formed at each of the three sides of the post structure, and each of the curved ridges terminates in a container contacting flange at the respective end thereof which is remote from the open end of the post structure.

The post structure of a corner piece in keeping with the present invention may have a container contacting surface at at least the base portion side thereof, near the closed end; or the post structure may have a container contacting surface on all three sides thereof, near the closed end.

In each of the unitary product cushioning devices of the present invention there may be a protuberance or "button" which is formed in one or more of the product supporting surfaces, and which extends upwardly therefrom. This provides an additional gripping action against the product which is placed in the container and is protected by the unitary product cushioning device.

Typical materials from which any unitary product cushioning device of the present invention may be formed include low density polyethylene, high density polyethylene, polyvinyl chloride, PET (polyethyleneteraphthalate), polystyrene, nylon, polypropylene, and appropriate mixtures and co-polymers thereof.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

Figure 12:
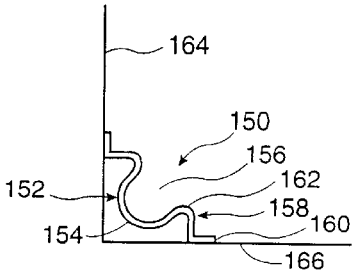
FIG. 12 is a view similar to FIG. 1, but showing a post structure which extends towards but does not contact a corner defining surface of the container in which the unitary product cushioning device is found.

Turning first to FIG. 12, some fundamental configuration principals are discussed. In particular, it will be understood that some issues surrounding the configuration of a unitary product cushioning device will be found in all embodiments of unitary product cushioning devices in keeping with the present invention. Thus, while the following discussion is particularly directed to the embodiment of FIG. 12, the particular principals which are discussed will be found in all embodiments.

The unitary product cushioning device 150, in this case, is one which is formed of a moldable resilient plastic material. It comprises a post structure 152, which has a first closed end 154, and a second open end 156. In the most general sense, the unitary product cushioning device 150 includes a first curved ridge 158 which is formed at a first side—in this case, the lower or right side, as seen in FIG. 12—of the unitary product cushioning device 150. The first curved ridge 158 terminates at a first container contacting flange 160, which is at the end of the first curved ridge 158 which is remote from the open end 156 of the post structure 152. A portion 162 of the first curved ridge 158 presents a product supporting surface. A further portion of the first curved ridge 158—being that portion thereof which extends between the product supporting surface 162 and the container contacting flange 160—is curved in a direction outwardly and away from the post structure 152.

Two planar surfaces of a container are shown in FIG. 12, at 164 and 166. As noted above, it will be understood that any unitary product cushioning device of the present invention is intended to be employed in a container which, in the broadest sense, is defined as having parallel and planar top and bottom surfaces, and at least three planar side surfaces. In the orientation of the surfaces 164 and 166 as they are shown in FIG. 12, surface 166 can be considered to be a planar bottom surface.

As will be discussed hereafter, a container having a rectilinear configuration is the most common configuration of container which may be found, being one which has parallel and planar top and bottom surfaces as well as a pair of parallel and planar end surfaces and a pair of parallel and planar side surfaces. However, the unitary product cushioning device of the present invention may be employed with other configurations of containers, such as those described above.

In the configuration shown in FIG. 12, a corner is shown which is defined by the intersection of surfaces 164 and 166. It will be noted that the container contacting flange 160 is in contact with the surface 166; and, if the configuration shown in FIG. 12 were to be turned over, surface 166 would be a planar top surface. In any event, it is seen that the product supporting surface 162 is parallel to the planar surface 166.

If a shock load is applied to the unitary product cushioning device 150, in a direction towards the surface 166, then that portion of the curved ridge 158 which is between the product supporting surface 162 and the container contacting flange 160 will at least temporarily be further curved in a direction outwardly and away from the post structure 152—that is, in the configuration shown in FIG. 12, to the right. Moreover, the product supporting surface 162 will at least temporarily move closer to the planar surface 166.

From FIG. 12, it can be seen that the post structure 152 may be configured so as to be curved away from the open end 156. Indeed, the post structure may essentially adopt a partial cylinder configuration.

Figure 1:
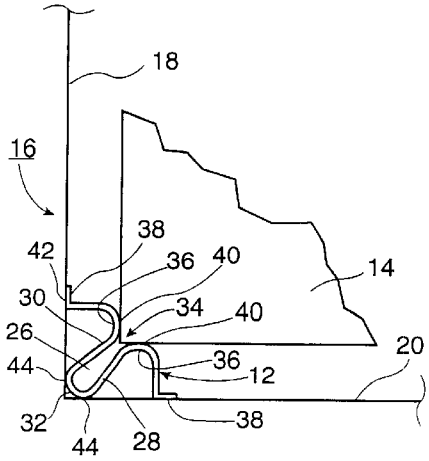
FIG. 1 is a side elevation view of a unitary product cushioning device in keeping with the present invention, together with a product and a container package.

On the other hand, the post structure 152 will be seen in other figures, such as FIG. 1, where a post structure 26 is shown to comprise a pair of sidewalls 28 and 30, each of which extends away from the open end 34, and is such that the post structure 26 terminates in a closed end 32. This is discussed in greater detail hereafter.

It will be noted that the post structure 152 in FIG. 12 does not touch either surfaces 164 or 166, whereas the post structure 26 shown in FIG. 1 touches at least one of the surfaces 18 and 20, and may contact both surfaces.

Thus, having regard to the embodiment of FIG. 1, there may be a container contacting surface 44 at one side of the unitary product cushioning device, but not necessarily at the other side. Moreover, there may be an axis of symmetry which bisects the post structure; and, as particularly seen in FIGS. 12 and 1, an axis of symmetry is such that there are curved ridges 158 and 36 which are formed at both sides of the respective post structure 152 or 26. Each of the curved ridges terminates at respective first and second container contacting flanges 160 in FIG. 12 and 38 in FIG. 1.

Figure 2:
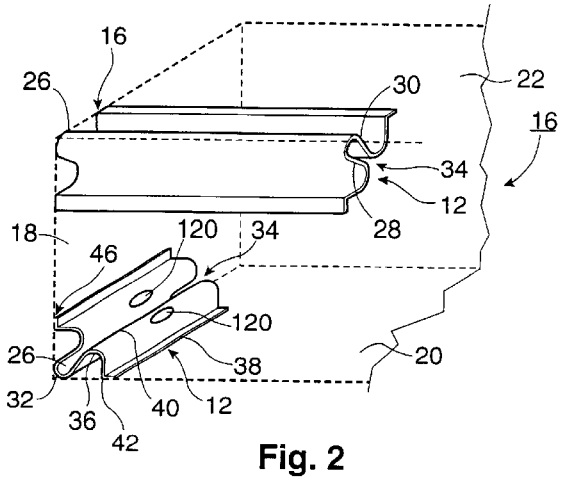
FIG. 2 illustrates the use of edge pieces in keeping with the present invention.

Reference will now be made to FIGS. 1 and 2, where a particular fundamental embodiment of a unitary product cushioning device in keeping with the present invention is illustrated. In this case, there is shown a unitary product cushioning device 12 which, especially as shown in FIG. 2, is being put to use as an edge piece. As discussed hereafter, FIG. 1 may also be considered to be a cross-section of an end cap unitary product cushioning device in keeping with the present invention.

Moreover, FIGS. 1 and 2 may be utilized to illustrate certain fundamental characteristics of any unitary product cushioning device in keeping with the present invention, whether it be an edge piece, end cap, or corner piece. Principally, any unitary product cushioning device in keeping with the present invention is intended for supporting a shock sensitive product, shown generally at 14, and the shock sensitive product is intended to be supported in an outer packaging container having a rectilinear configuration. The outer packaging container is shown generally at 16; and, in the views of the rectilinear outer packaging container shown in FIGS. 1 and 2, the container comprises six planar surfaces, including surfaces 18, 20, and 22.

In each unitary product cushioning device in keeping with the present invention, there is a post structure 26, which has a pair of sidewalls 28 and 30. Each post 26 has a first closed end 32, and a second open end 34.

The open end 34 has a curved ridge formed at at least a first side of the post structure. In the embodiment of FIGS. 1 and 2, there is a pair of curved ridges 36. Each ridge terminates in a container contacting flange 38, each of which is located at the end of the curved ridge 36 which is remote from the open end 34. The intersection between curved ridge 36 and the respective container contacting flange 38 is shown at 42. A portion of the curved ridge 36 presents a product supporting surface, shown at 40. Obviously, in the specific embodiment shown in FIGS. 1 and 2, there are two product supporting surfaces 40, but only one functions as a product supporting surface; the other functions as a limiting surface, precluding movement of the product 14 further towards the container surface 18. In another orientation, of course, the container may be placed on its side, so that the roles of the respective product supporting surfaces 40 are reversed.

A further portion of the ridge 36 is curved in a direction outwardly and away from the post structure 26.

There is also a container contacting surface formed in the post structure 34, and shown at 44.

When the unitary product cushioning device 12 is placed in a rectangular container so that the post structure 26 extends into a corner defined by the intersection of the surfaces 18 and 20, the container contacting surfaces 44 at the at least one side of the post structure 26—for purposes of the present discussion, consider the container contacting surface 44 which contacts the container surface 20—and the container contacting flange 38, will indeed contact at least one of the two surfaces 18 and 20. The embodiment shown in FIGS. 1 and 2 has both surfaces 18 and 20 being contacted by the respective container contacting flanges 38 and container contacting surfaces 44.

It is also obvious that the product supporting surface 40 will be parallel to the container surface 20.

When a shock load is applied to the unitary product cushioning device 12 in a direction toward the container surface 20, such as when a container 16 having the product 14 inside it is dropped, the curved ridge 36 will at least temporarily extend further away from the post structure 26 and become more acute. Moreover, the product supporting surface 40 will at least temporarily move closer to the container surface 20. Thus, it will be seen that the product 14 is cushioned, and shock which might be experienced by the shock sensitive product 14 is at least reduced.

It is evident from FIGS. 1 and 2 that the embodiment of the unitary product cushioning device shown in those figures has an axis of symmetry which bisects the post structure 26. Thus, as already described, there is a curved ridge 36 at each side of the structure, and so on. The importance of the discussion concerning an axis of symmetry through the post structure so that a container contacting flange 38, a container contacting surface 44, and a product supporting surface 40 is disposed at each side of the axis of symmetry, becomes more clear when it is considered that such characteristics are true of an end cap but not of a corner piece, as described hereafter.

The edge piece configuration of the unitary product cushioning device of the present invention may be formed from an extruded plastic. If so, it then has first and second ends, of which an end 46 is shown, the other end of each device 12 shown in FIG. 2 having been removed for the sake of illustration of the device. When an edge piece is used, there will in fact be four devices utilized in a rectilinear container 16. Two devices will be used at opposed ends or sides at the bottom of the container 16, the other two devices will be used on the other sides or ends of the container at the top thereof. One such device is shown at the bottom and one end of the container 16 in FIG. 2; and another device is shown at the top and along one side of the container 16 in FIG. 2, it being understood that another device will be on the other side and also at the top of the container.

Figure 7:
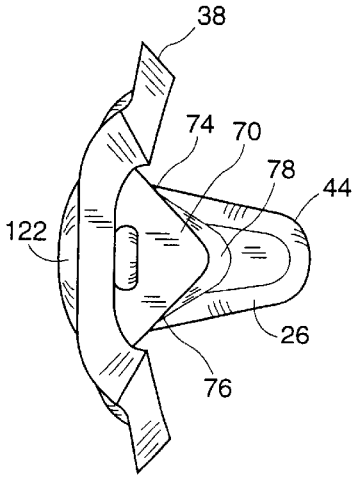
FIG. 7 is an end elevation of an end cap in keeping with the present invention.
Figure 6:
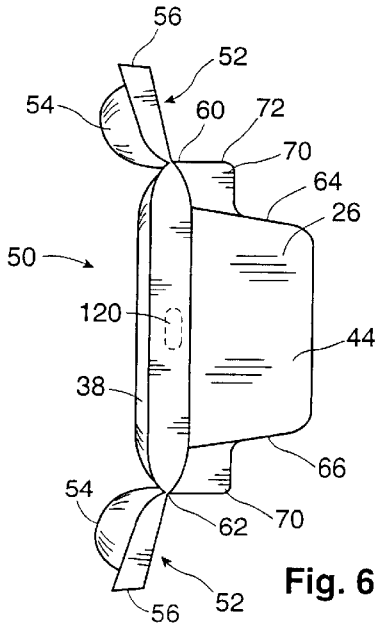
FIG. 6 is a side elevation of an end cap in keeping with the present invention.
Figure 8:
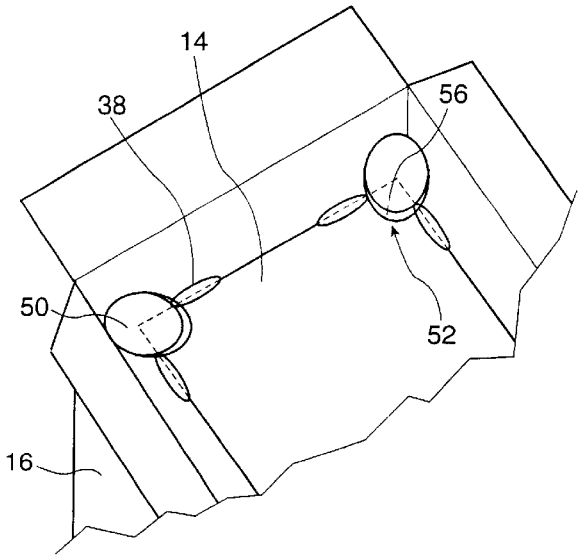
FIG. 8 illustrates the use of an end cap in keeping with the present invention.

As noted above, FIG. 1 may also be considered to be a cross-section of an end cap, such as that which is shown in FIGS. 6, 7, and 8.

Turning now to FIGS. 6, 7, and 8, an end cap is shown, which end cap may be formed from a plastics material which has been molded by drape molding, vacuum molding, blow molding, or injection molding. It is evident that an end cap may not be extruded since it has closed ends, as discussed hereafter.

Each end cap has a predetermined length, and has first and second ends 60 and 62 which are closed. The post structure 26 also has first and second ends 64 and 66, which are also closed.

FIG. 8 shows the application of an end cap, where two unitary product cushioning devices 50 are placed, at each end of a product 14, within a container 16.

As noted in FIG. 6, the length of the post structure 26 is less than the length of the end cap 50. It will be noted that the end cap 50 further comprises a pair of extension wings 52, one at each of the first and second ends 60 and 62. Each extension wing 52 comprises a curved ridge 54 which is curved away from the post structure 26, and which terminates in a container contacting flange 56.

It will be evident, particularly from FIGS. 6 and 8, that each of the container contacting flanges 56 of the extension wings 52 is disposed in a pair of planes which may be substantially parallel to each other, so as to contact the bottom and top surfaces of the container 16 when in place. Thus, each of the further planes in which the container contacting flanges 56 are located may be substantially perpendicular to each of the first and second planes by which the other container contacting flanges 38 and the container contacting surfaces 44 of the post structure 26 are defined. It will also be evident from an examination of FIGS. 6 and 8 that the predetermined length of the end cap 50 is measured between the container contacting flanges 56 of the extension wings 52.

However, it must be noted that the planes in which the container contacting flanges 56 of the extension wings 52 are disposed may have approximate parallelism. Indeed, the planes in which the container contacting flanges 56 are disposed may have parallelism plus or minus zero degrees to 40° or more with respect to each other—that is, if the planes of the respective container contacting flanges 56 were extended and were such that they would intersect with each other, there would be up to 80° or more out of parallelism of each plane with respect to the other. However, as noted above, it is usual that the planes of the container contacting flanges 56 may be as much as 10° off parallel with respect to each other in a practical unitary product cushioning device.

In general, an end cap unitary product cushioning device of the present invention is formed with the post structure 26 having a predetermined length and a predetermined width at its open end, as can be noted from an examination of FIGS. 6 and 7. Moreover, the sidewalls of the post structure are sloped towards each other, as shown in FIG. 7, in a direction from the open end towards the closed end thereof. The first and second ends 64 and 66 of the post structure 26 are also sloped towards each other in a direction from the open towards the closed end.

A further inspection of FIGS. 6, 7, 9, 10, and 11 will show a pair of rectilinear depressions 70 which is formed, one at each end of the post structure 26. Each rectilinear depression 70 has a substantially planar end wall 72, and a pair of sidewalls 74 and 76, which are perpendicularly disposed to each other. The sidewalls 74 and 76 intersect at a vertex 78, which is disposed along the axis of symmetry of the end cap structure.

Figure 9:
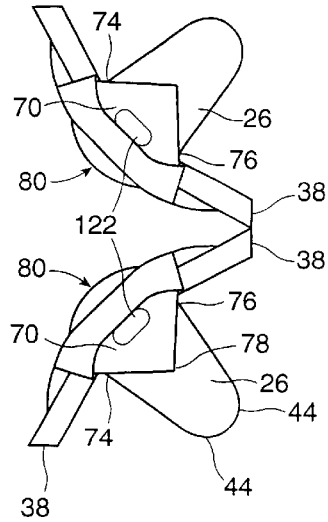
FIG. 9 is an end elevation of a further embodiment of end cap in keeping with the present invention.

It is shown particularly in FIG. 9 that a pair of similarly configured unitary product cushioning devices 80 may be employed at opposite sides of a rectilinear container (not shown), so as to cushion a rectilinear product received therein. Obviously the rectilinear product, in this case, will be received and retained by the rectilinear depressions 70.

Indeed, FIG. 9 shows that a unitary product cushioning device of the present invention may be formed as a pair of similarly configured unitary product cushioning devices 80 which are joined together at a respective one of the container contacting flanges 38 which are at a respective first or second side of the respective post structure 26 of each unitary product cushioning device 80.

Figure 10:
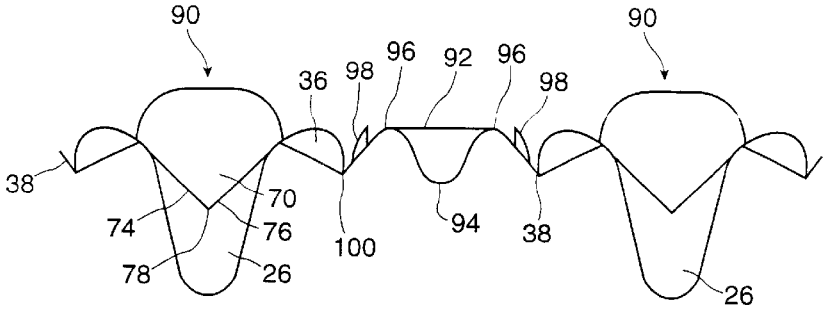
FIG. 10 is an end view of a still further embodiment of end cap in keeping with the present invention.
Figure 11:
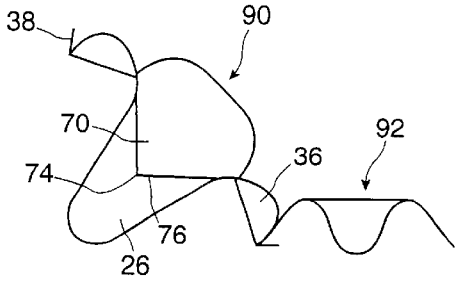
FIG. 11 is a partial view of the embodiment of FIG. 11 when folded into its operative configuration.

Referring to FIGS. 10 and 11, a pair of similarly configured unitary product cushioning devices 90 may be formed together as a unitary structure, having a further extension structure 92 interposed between a respective one of the container contacting flanges 38 at a respective first or second side of the respective post structure 26 of each structure 90. This will accommodate a wider product 14, as will be particularly inferred from an examination of FIG. 11, where it is evident that the pair of product cushioning device structures 90 may be folded up to present a structure for receiving a rectilinear product.

Moreover, from FIGS. 10 and 11, it can be seen that the further extension structure 92 may be formed flat, but more particularly it will be formed with a centrally located ridge 94 which is parallel to the container contacting flanges 38 of each of the structures 90. The extension structure 92 further has a pair of rims 96 which are located one at each side of the centrally located ridge 94. Each of the rims 96 includes an upstanding wing portion 98. Each of the curved ridges 36 of the structures 90 includes an opening (not shown) formed therein.

Thus, when the respective container contacting flanges 38 and the rims 96 are oriented towards each other by a flexible hinge 100 formed between them being bent, then the wing portions 98 are received in the respective openings so that the structures are locked together with each structure 90 being locked to the interposed ridge structure 92.

Figure 3:
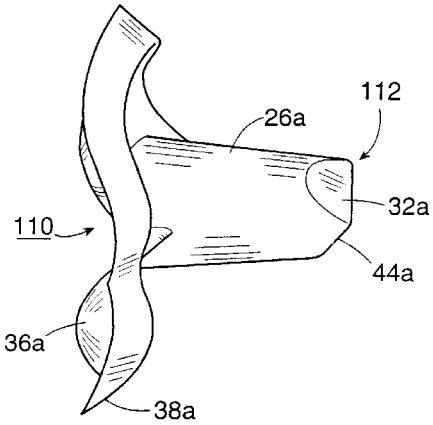
FIG. 3 is an elevation of a corner piece in keeping with the present invention.
Figure 4:
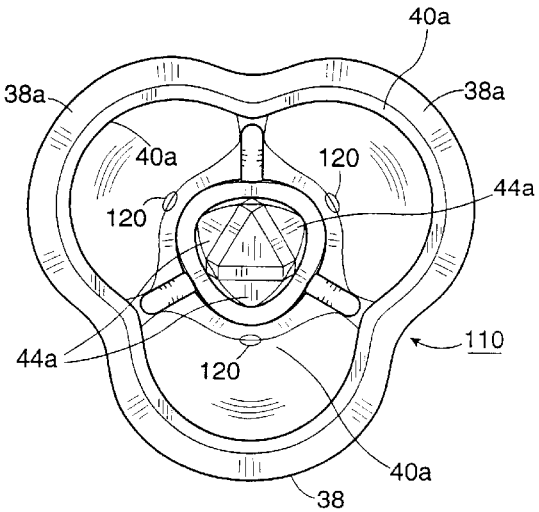
FIG. 4 is an end view of a corner piece in keeping with the present invention.
Figure 5:
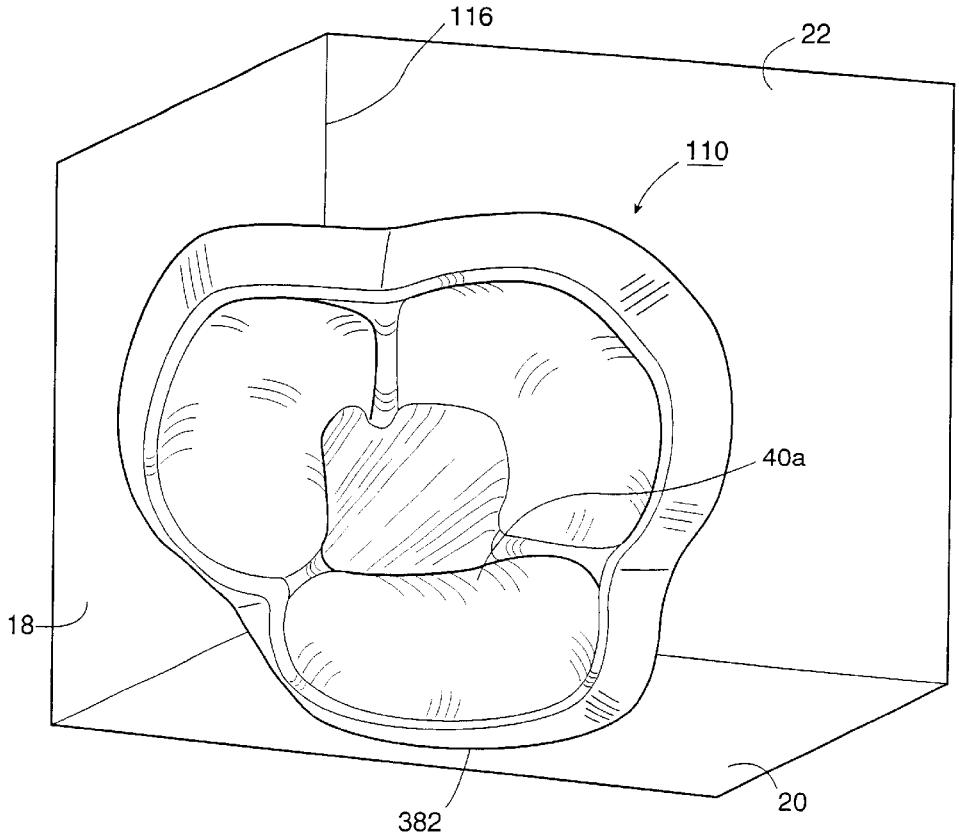
FIG. 5 illustrates the use of a corner piece in keeping with the present invention.

Referring now to FIGS. 3, 4, and 5, a unitary product cushioning device of the present invention is shown as being formed in the configuration of a corner piece 110. Here, the corner piece is intended to be fitted into a corner of a rectilinear container, which corner is defined by three intersecting surfaces such as surfaces 18, 20, and 22 shown in each of FIGS. 2 and 5. Each of the surfaces 18, 20, and 22 are mutually perpendicular one to another.

Similar structural features retain the same reference numeral, but are differentiated by the additional suffix "a". Thus, each corner piece 110 as shown in FIGS. 3,4, and 5 has a post structure 26*a*, with container contacting surfaces 44*a*. There are curved ridges 36*a*, terminating in container contacting flanges 38*a*.

It should be particularly noted that each post structure 26*a* may be formed having the cross-section of an isosceles triangle. Of course, it is understood that an equilateral triangle is a special case of an isosceles triangle, with the two sides being each the same length as the base portion. Thus, the two sides which are subtended by the base portion may be either shorter or longer than the base portion of such a post structure 26*a*.

As seen particularly in FIGS. 4 and 5, each post structure 26*a* may be formed having an equilateral triangular cross-section, so that there are three sides to the post structure 26*a*. The post structure 26*a* is truncated as at 112, at the closed end 32*a* of the post structure 26*a*. It is also evident that there are three axes of symmetry, each being perpendicular to one of the three sides of the post structure 26*a*.

The open end of the post structure 26*a* has a curved ridge 36*a* formed at least at the base portion side thereof, or at each of the three sides thereof, with each ridge terminating in a container contacting flange 38*a*.

Obviously, each of the curved ridges 36*a* presents a product supporting surface 40*a*. Moreover, as is seen particularly from FIG. 3, a further portion of each of the curved ridges 36 is curved in a direction outwardly and away from the post structure 26*a*.

When the corner piece 110 is fitted into a corner of a rectilinear container, only one of the three intersecting surfaces of the rectilinear container will be contacted by one of the container contacting surfaces 38*a*. As shown in FIG. 5, that surface, in that illustration, is surface 20. Likewise, only one of the container contacting surfaces 44*a* at the closed end 32*a* of the post structure 26*a* will contact the surface 20.

It will be obvious from FIG. 5 that the respective product supporting surface 40*a* which is oriented so as to, in fact, support a product 14 when placed thereon, is parallel to the surface 20.

Thus, as before, when a shock load is applied to the unitary product cushioning device, configured in this case as a corner post 110, in a direction towards the contacted container surface 20, the respective curved ridge 36 will at least temporarily extend further away from the post structure and become more acute, and the respective product supporting surface 40*a* will at least temporarily move closer to the contacted container surface 20.

A protuberance or "button" may be formed in any of the product supporting surfaces 40 or 40*a* to extend upwardly therefrom. The protuberance or "button" is shown at 120 in FIGS. 2, 4, and 6. Further, a protuberance may be formed in each of the planar end walls 72 of the rectilinear depressions 70, and is shown as 122 in FIGS. 7 and 9.

The purpose of the protuberances 120 and 122 is to provide an additional means to urge the supported product 14 towards the centre of the container 16. Additionally, the protuberances 120 and 122 provide an initial structure which may collapse and thereby absorb shock force before the rims 36 begin to collapse under shock loading.

When a corner piece or end piece is employed, it will be seen that shock loading from the side of the container will also be absorbed. In all instances, and in any event, it will be seen that shock loading forces will be transferred from the container 16 to the unitary product cushioning device through the container contacting flanges 38 or 38*a* and the container contacting surfaces 44 or 44*a* formed on the post structures 26 or 26*a*. Moreover, due to the elasticity of the plastics materials from which the unitary product cushioning devices of the present invention are manufactured, there is no permanent deformation of the unitary product cushioning devices when they have been put to the task of absorbing shock loading so as to protect the shock sensitive product that is cushioned in them.

To that end, drop tests on a variety of embodiments of unitary product cushioning devices in keeping with the present invention, having differing sizes and being intended for different purposes, have indicated, in each instance, the ability of the unitary product cushioning devices of the present invention to meet all drop test standards. Those standards vary from case to case, depending on the product to be protected, the size and nature of the product cushioning device, and so on. In general, a unitary product cushioning device in keeping with the present invention will reduce the impact forces imparted to the product being cushioned, to a level below 100 g's typically, to a level of 50 g's to 60 g's for a drop of about one meter.

It has been noted that the embodiment of the unitary product cushioning device of the present invention which is employed as an edge piece may be extruded. Otherwise, the molding technique which may be employed can be drape molding, vacuum molding, blow molding, or injection molding. Any such molding technique which is employed is well known to those skilled in the plastics molding arts, and requires no further discussion herein.

Generally, and especially when drape molding or vacuum molding techniques are employed, the unitary product cushioning device of the present invention is molded at an angle which is less than 90 degrees to the product supporting surface. This may give added integrity to the unitary product cushioning device of the present invention, and provides for easier removal from the mold in which or over which the unitary product cushioning device of the present invention has been molded.

Likewise, the materials from which the unitary product cushioning devices of the present invention may be molded include low density polyethylene, high density polyethylene, polyvinyl chloride, PET, polystyrene, nylon, polypropylene, and appropriate mixtures and co-polymers thereof. However, it will be understood that the above list of materials is intended to be illustrative but not exhaustive.

There has been described a variety of unitary product cushioning devices, each of which is in keeping with the principals of the present invention. Other modifications and alterations may be used in the design and manufacture of the apparatus of the present invention without departing from the spirit and scope of the accompanying claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with a particular verb is intended to enhance the scope of the particular characteristic; e.g., substantially perpendicular is intended to mean perpendicular, nearly perpendicular, and/or exhibiting characteristics associated with perpendicularity.

What is claimed is:

1. A unitary product cushioning device for supporting a shock sensitive product in an outer packaging container, said unitary product cushioning device being formed of a moldable resilient plastics material, and comprising:

a post structure having a first closed end and a second open end; and a first curved ridge formed at at least a first side of said post structure, said first curved ridge terminating at a first container contacting flange at the end thereof remote from said open end of said post structure;

wherein a portion of at least said first curved ridge at said first side of said post structure presents a product supporting surface;

wherein a further portion of at least said first curved ridge at said first side of said post structure is curved in a direction outwardly and away from said post structure;

wherein, when said unitary product cushioning device is placed in an outer packaging container having parallel and planar top and bottom surfaces and at least three planar side surfaces, each of which is perpendicular to said planar top and bottom surfaces, so that said post structure extends towards a corner defined by at least two of said planar surfaces, said first container contacting flange will contact one of said planar surfaces, and said first product supporting surface will be parallel to said one of said planar surfaces; and wherein, when a shock load is applied to said unitary product cushioning device in a direction towards said one of said planar surfaces, said further portion of said first curved ridge at said first side of said post structure will at least temporarily be further curved in a direction outwardly and away from said post structure, and said product supporting surface will at least temporarily move closer to said one of said planar surfaces.

2. The unitary product cushioning device of claim 1, wherein said post structure is curved away from said second open end thereof.

3. The unitary product cushioning device of claim 1, wherein said post structure has a pair of side walls which extend away from said second open end thereof, and said side walls terminate in said closed end of said post structure.

4. The unitary product cushioning device of claim 3, wherein at least one of said pair of side walls of said post structure has a container contacting surface near said closed end;

whereby, when said unitary product cushioning device is placed in an outer packaging container, said container contacting surface will contact one of said corner defining planar surfaces.

5. The unitary product cushioning device of claim 4, wherein said container contacting surface is on the side wall which is at said first side of said post structure;

whereby said container contacting surface will contact said one of said planar surfaces.

6. The unitary product cushioning device of claim 1, wherein said post structure may be placed in a container so that said post structure extends towards a corner defined by at least one of said planar side surfaces and one of said planar top and bottom surfaces.

7. The unitary product cushioning device of claim 6, wherein there is an axis of symmetry which bisects said post structure;

whereby first and second curved ridges are formed at first and second sides of said post structure, and each of said first and second curved ridges terminates at a respective first and second container contacting flange.

8. The unitary product cushioning device of claim 7, wherein said post structure has a pair of said walls which extend away from said second open end thereof, and said side walls terminate in said closed end of said post structure; and wherein each of said pair of side walls of said post structure has a container contacting surface near said closed end.

9. The unitary product cushioning device of claim 1, wherein said device is formed of an extruded plastics material so as to have first and second ends, each of which is open.

10. The unitary product cushioning device of claim 1, wherein said device is formed of a plastics material which has been molded by one of the molding processes chosen from the group consisting of drape molding, vacuum molding, blow molding, and injection molding.

11. The unitary product cushioning device of claim 6, wherein said device is formed of a plastics material which has been molded by one of the molding processes chosen from the group consisting of drape molding, vacuum molding, blow molding, and injection molding;

wherein said device is formed as an end cap having a predetermined length, wherein said end cap has first and second ends which are closed; and wherein said post structure has first and second ends which are closed.

12. The unitary product cushioning device of claim 11, wherein the length of said post structure is less than the length of said end cap, and wherein said end cap further comprises a pair of extension wings, one at each of said first and second closed ends thereof;

wherein each of said extension wings comprises a curved ridge which is curved away from said post structure and terminates in a container contacting flange; and wherein said predetermined length of said end cap is measured between said container contacting flanges of said extension wings.

13. The unitary product cushioning device of claim 12, wherein said container contacting flanges of said extension wings are disposed in a pair of planes have parallelism plus or minus zero degrees to 10° with respect to each other.

14. The unitary product cushioning device of claim 13, further comprising a pair of rectilinear depressions formed one at each end of said post structure, each of said rectilinear depressions having a substantially planar end wall and a pair of side walls perpendicularly disposed to each other and intersecting at a vertex which is disposed along said axis of symmetry.

15. The unitary product cushioning device of claim 14, when formed as a pair of similarly configured unitary product cushioning devices joined together at a respective one of said container contacting flanges at a respective first or second side of the respective post structure of each.

16. The unitary product cushioning device of claim 14, when formed as a pair of similarly configured unitary product cushioning devices, and having a further extension structure interposed between a respective one of said container contacting flanges at a respective first or second side of the respective post structure of each.

17. The unitary product cushioning device of claim 16, wherein said extension structure is formed with a centrally located ridge parallel to said container contacting flanges of each of said pair of similarly configured unitary product cushioning devices, and a pair of rims located one at each side of said centrally located ridge;

wherein a flexible hinge is formed between each of said pair of rims and the respective container contacting flange; and wherein an upstanding wing portion is formed in one of each of said rims or said curved ridges which are adjacent said centrally located ridge, and a co-operating opening is formed in the other of each of said rims or said curved ridges;

whereby when said respective container contacting flanges and said rims are oriented towards each other by said flexible hinges having been bent, said upstanding wing portions are received in the respective openings so as to lock said pair of similarly configured unitary product cushioning devices and said interposed ridge structure in place; and whereby said similarly configured unitary product cushioning devices may be placed at opposed sides of a container having a predetermined size so as to receive a rectilinear product having predetermined dimensions in said rectilinear depressions.

18. The unitary product cushioning device of claim 1, wherein a protuberance is formed in said product supporting surface, and extends upwardly therefrom.

19. The unitary product cushioning device of claim 12, wherein a protuberance is formed in at least one of said product supporting surfaces, and extends upwardly therefrom.

20. The unitary product cushioning device of claim 14, wherein a protuberance is formed in at least one of said product supporting surfaces, and extends upwardly therefrom.

21. The unitary product cushioning device of claim 1, when formed from a plastics material chosen from the group consisting of low density polyethylene, high density polyethylene, polyvinyl chloride, PET, polystyrene, nylon, polypropylene, and mixtures and co-polymers thereof.

22. A unitary product cushioning device for supporting a shock sensitive product in an outer packaging container having a rectilinear configuration, said unitary product cushioning device being formed of a moldable resilient plastics material, and comprising:

a post structure having first closed end and a second open end;

said open end having a first curved ridge formed at at least a first side of said post structure, said first curved ridge terminating at a first container contacting flange at the end thereof remote from said open end;

wherein a portion of at least said first curved ridge at said first side of said post structure presents a product supporting surface;

wherein a further portion of at least said first curved ridge at said first side of said post structure is curved in a direction outwardly and away from said post structure;

wherein, when said unitary product cushioning device is placed in a rectilinear container so that said post structure extends towards a corner defined by at least two surfaces of said rectilinear container, said container contacting flange will contact one of said at least two container surfaces, and said product supporting surface will be parallel to said one of said at least two container surfaces; and wherein, when a shock load is applied to said unitary product cushioning device in a direction towards said one of said at least two container surfaces, said further portion of said first curved ridge will at least temporarily be further curved in a direction outwardly and away from said post structure, and said product supporting surface will at least temporarily move closer to said one of said at least two container surfaces.

23. The unitary product cushioning device of claim 22, wherein there is a container contacting surface near said closed end of said post structure at at least said first side thereof.

24. The unitary product cushioning device of claim 23, wherein there is an axis of symmetry which bisects said post structure;

whereby a curved ridge is formed on first and second sides of said axis of symmetry at first and second sides of said post structure, and having a container contacting flange at both sides of said post structure;

wherein said container contacting flanges are disposed in first and second planes which are substantially perpendicular one to the other;

wherein there is a product supporting surface and a container contacting surface on each side of said post structure, wherein each product supporting surface is near said open end of said post structure, and each said container contacting surface is near said closed end of said post structure, and wherein said container contacting surfaces at each side of said post structure are also each disposed in said first and second planes;

whereby, when said unitary product cushioning device is placed in a rectilinear container, said container contacting surfaces and said container contacting flanges will each contact a respective one of said at least two surfaces of said rectilinear container, and said product supporting surfaces will each be parallel to a respective one of said at least two surfaces.

25. The unitary product cushioning device of claim 24, wherein said device is formed of an extruded plastics material so as to have first and second ends, each of which is open.

26. The unitary product cushioning device of claim 24, wherein said device is formed of a plastics material which has been molded by one of the molding processes chosen from the group consisting of drape molding, vacuum molding, blow molding, and injection molding.

27. The unitary product cushioning device of claim 26, when formed as an end cap having a predetermined length, wherein said end cap has first and second ends which are closed; and wherein said post structure has first and second ends which are closed.

28. The unitary product cushioning device of claim 27, wherein the length of said post structure is less than the length of said end cap, and wherein said end cap further comprises a pair of extension wings, one at each of said first and second closed ends thereof;

wherein each of said extension wings comprises a curved ridge which is curved away from said post structure and terminates in a container contacting flange; and wherein said predetermined length of said end cap is measured between said container contacting flanges of said extension wings.

29. The unitary product cushioning device of claim 28, wherein said container contacting flanges of said extension wings are disposed in a pair of planes have parallelism plus or minus zero degrees to 10° with respect to each other.

30. The unitary product cushioning device of claim 29, further comprising a pair of rectilinear depressions formed one at each end of said post structure, each of said rectilinear depressions having a substantially planar end wall and a pair of side walls perpendicularly disposed to each other and intersecting at a vertex which is disposed along said axis of symmetry;

whereby a pair of similarly configured unitary product cushioning devices may be employed at opposed sides of a rectilinear container so as to cushion a rectilinear product therein.

31. The unitary product cushioning device of claim 30, when formed as a pair of similarly configured unitary product cushioning devices joined together at a respective one of said container contacting flanges at a respective first or second side of the respective post structure of each.

32. The unitary product cushioning device of claim 31, when formed as a pair of similarly configured unitary product cushioning devices, and having an extension structure interposed between a respective one of said container contacting flanges at a respective first or second side of the respective post structure of each.

33. The unitary product cushioning device of claim 32, wherein said extension structure is formed with a centrally located ridge parallel to said container contacting flanges of each of said pair of similarly configured unitary product cushioning devices, and a pair of rims located one at each side of said centrally located ridge;

wherein a flexible hinge is formed between each of said pair of rims and the respective container contacting flange; and wherein an upstanding wing portion is formed in one of each of said rims or said curved ridges which are adjacent said centrally located ridge, and a co-operating opening is formed in the other of each of said rims or said curved ridges;

whereby, when said respective container contacting flanges and said rims are oriented towards each other by said flexible hinges having been bent, said upstanding wing portions are received in the respective openings so as to lock said pair of similarly configured unitary product cushioning devices and said interposed ridge structure in place; and whereby said similarly configured unitary product cushioning devices may be placed at opposed sides of a rectilinear container of a predetermined size so as to receive a rectilinear product having predetermined dimensions in said rectilinear depressions.

34. The unitary product cushioning device of claim 1, wherein said device is formed of a plastics material which has been molded by one of the molding processes chosen from the group consisting of drape molding, vacuum molding, blow molding, and injection molding; and wherein said unitary product cushioning device is formed as a corner piece to be fitted into a corner of a rectilinear container, which corner is defined by three intersecting surfaces which are mutually perpendicular one to another.

35. The unitary product cushioning device of claim 34, wherein said post structure is formed having an isosceles triangular cross-section having a base portion and two side portions, and is truncated;

wherein said open end of said post structure has at least a first curved ridge formed at said base portion side thereof, with said at least first curved ridge terminating in a container contacting flange at the end thereof remote from said open end of said post structure;

wherein a portion of said at least first curved ridge presents a first product supporting surface;

wherein a further portion of at least first said curved ridge is curved in a direction outwardly and away from said post structure;

wherein, when said unitary product cushioning device is fitted into a corner of a rectilinear container, one of said three intersecting surfaces of said rectilinear container will be contacted by said container contacting flange at said base portion side of said post structure;

wherein said first product supporting surface will be parallel to said one contacted container surface; and wherein, when a shock load is applied to said unitary product cushioning device in a direction towards said one contacted container surface, said further portion of said first curved ridge will at least temporarily be further curved in a direction away from said post structure, and said first product supporting surface will at least temporarily move closer to said one contacted container surface.

36. The unitary product cushioning device of claim 35, wherein said post structure has an equilateral triangular cross-section; and wherein a curved ridge is formed at each of the three sides thereof, and each of said curved ridges terminates in a container contacting flange at the respective end thereof remote from said open end of said post structure.

37. The unitary product cushioning device of claim 35, wherein said post structure has a container contacting surface at at least said base portion side thereof, near said closed end.

38. The unitary product cushioning device of claim 37, wherein said post structure has container contacting surface on all three sides thereof, near said closed end.

39. The unitary product cushioning device of claim 35, wherein a protuberance is formed in at least one of said product supporting surfaces, and extends upwardly therefrom.

40. The unitary product cushioning device of claim 22, when formed from a plastics material chosen from the group consisting of low density polyethylene, high density polyethylene, polyvinyl chloride, PET, polystyrene, nylon, polypropylene, and mixtures and co-polymers thereof.

* * * * *